US006845953B2

(12) United States Patent
Kane et al.

(10) Patent No.: US 6,845,953 B2
(45) Date of Patent: Jan. 25, 2005

(54) METHOD AND SYSTEM FOR CHECKING TRACK INTEGRITY

(75) Inventors: Mark Edward Kane, Orange Park, FL (US); James Francis Shockley, Orange Park, FL (US); Harrison Thomas Hickenlooper, Palatka, FL (US)

(73) Assignee: Quantum Engineering, Inc., Orange Park, FL (US)

( * ) Notice: Subject to any disclaimer, the term of this patent is extended or adjusted under 35 U.S.C. 154(b) by 1 day.

(21) Appl. No.: 10/267,962

(22) Filed: Oct. 10, 2002

(65) Prior Publication Data

US 2004/0069909 A1 Apr. 15, 2004

(51) Int. Cl.[7] ..... B61L 21/00
(52) U.S. Cl. ..... 246/20; 246/167 R
(58) Field of Search ..... 246/2 R, 4, 20, 246/23, 167 R, 174, 175, 122 R, 124

(56) References Cited

U.S. PATENT DOCUMENTS

| | | | | |
|---|---|---|---|---|
| 4,181,943 A | | 1/1980 | Mercer, Sr. et al. | |
| 4,306,694 A | | 12/1981 | Kuhn | |
| 4,459,668 A | | 7/1984 | Inoue et al. | |
| 4,561,057 A | | 12/1985 | Haley, Jr. et al. | |
| 4,711,418 A | | 12/1987 | Aver, Jr. et al. | |
| 4,728,063 A | | 3/1988 | Petit et al. | |
| 4,886,226 A | | 12/1989 | Frielinghaus | |
| 5,072,900 A | | 12/1991 | Malon | |
| 5,129,605 A | | 7/1992 | Burns et al. | |
| 5,145,131 A | | 9/1992 | Franke | |
| 5,177,685 A | | 1/1993 | Davis et al. | |
| 5,332,180 A | | 7/1994 | Peterson et al. | |
| 5,340,062 A | * | 8/1994 | Heggestad | 246/5 |
| 5,364,047 A | | 11/1994 | Petit et al. | |
| 5,394,333 A | | 2/1995 | Kao | |
| 5,398,894 A | | 3/1995 | Pascoe | |
| 5,452,870 A | | 9/1995 | Heggestad | |
| 5,470,034 A | | 11/1995 | Reeves | |
| 5,529,267 A | * | 6/1996 | Giras et al. | 246/120 |
| 5,533,695 A | | 7/1996 | Heggestad et al. | |
| 5,620,155 A | | 4/1997 | Michalek | |
| 5,699,986 A | | 12/1997 | Welk | |
| 5,740,547 A | | 4/1998 | Kull et al. | |
| 5,743,495 A | | 4/1998 | Welles, II et al. | |
| 5,751,569 A | | 5/1998 | Metel et al. | |
| 5,803,411 A | | 9/1998 | Ackerman et al. | |

(List continued on next page.)

OTHER PUBLICATIONS

"Testimony of Jolene M. Molitoris, Federal Railroad Administrator, U.S. Department of Transportation before the House Committee on Transportation and Infrastucture Subcommittee on Railroads", Federal Railroad Administration, United States Department of Transportation, Apr. 1, 1998.
"System Architecture, ATCS Specification 100", May 1995.
"A New World for Communications & Signaling", Progressive Railroading, May 1986.

(List continued on next page.)

*Primary Examiner*—S. Joseph Morano
*Assistant Examiner*—Robert J. McCarry, Jr.
(74) *Attorney, Agent, or Firm*—Piper Rudnick LLP; Steven B. Kelber

(57) ABSTRACT

A train control system includes a control module that determines a position of a train using a positioning system and consults a database to determine when the train is approaching a portion of track monitored by a track circuit. When the train is near a track circuit, but while the train is still far enough away from the track circuit such that the train can be stopped before reaching the portion of track monitored by the track circuit, the train transmits an interrogation message to a transceiver associated with the track circuit. When the track circuit receives the interrogation message, a test is initiated. The test results are transmitted back to the train. The train takes corrective action if the track circuit fails to respond or indicates a problem.

71 Claims, 4 Drawing Sheets

U.S. PATENT DOCUMENTS

| | | | | | |
|---|---|---|---|---|---|
| 5,828,979 | A | | 10/1998 | Polivka et al. | |
| 5,867,122 | A | | 2/1999 | Zahm et al. | |
| 5,944,768 | A | | 8/1999 | Ito et al. | |
| 5,950,966 | A | * | 9/1999 | Hungate et al. | 246/62 |
| 5,978,718 | A | | 11/1999 | Kull | |
| 5,995,881 | A | | 11/1999 | Kull | |
| 6,049,745 | A | | 4/2000 | Douglas et al. | |
| 6,081,769 | A | | 6/2000 | Curtis | |
| 6,102,340 | A | * | 8/2000 | Peek et al. | 246/121 |
| 6,135,396 | A | * | 10/2000 | Whitfield et al. | 246/182 R |
| 6,179,252 | B1 | | 1/2001 | Roop et al. | |
| 6,218,961 | B1 | * | 4/2001 | Gross et al. | 340/903 |
| 6,311,109 | B1 | * | 10/2001 | Hawthorne et al. | 701/19 |
| 6,322,025 | B1 | | 11/2001 | Colbert et al. | |
| 6,345,233 | B1 | | 2/2002 | Erick | |
| 6,371,416 | B1 | | 4/2002 | Hawthorne | |
| 6,373,403 | B1 | | 4/2002 | Korver et al. | |
| 6,374,184 | B1 | | 4/2002 | Zahm et al. | |
| 6,377,877 | B1 | | 4/2002 | Doner | |
| 6,397,147 | B1 | | 5/2002 | Whitehead | |
| 6,421,587 | B2 | | 7/2002 | Diana et al. | |
| 6,456,937 | B1 | | 9/2002 | Doner et al. | |
| 6,459,964 | B1 | | 10/2002 | Vu et al. | |
| 6,459,965 | B1 | | 10/2002 | Polivka et al. | |
| 6,487,478 | B1 | | 11/2002 | Azzaro et al. | |
| 2001/0056544 | A1 | | 12/2001 | Walker | |
| 2002/0070879 | A1 | | 6/2002 | Gazit et al. | |

OTHER PUBLICATIONS

"Advanced Train Control Gain Momentum", Progressive Railroading, Mar. 1986.

"Railroads Take High Tech in Stride", Progressive Railroading, May 1985.

Lyle, Denise, "Positive Train Control on CSXT", Railway Fuel and Operating Officers Association, Annual Proceedings, 2000.

Lindsey, Ron A., "C B T M, Communications Based Train Management", Railway Fuel and Operating Officers Association, Annual Proceedings, 1999.

Moody, Howard G, "Advanced Train Control Systems A System to Manage Railroad Operations", Railway Fuel and Operating Officers Association, Annual Proceedings, 1993.

Ruegg, G.A., "Advanced Train Control Systems ATCS", Railway Fuel and Operating Officers Association, Annual Proceedings, 1986.

Malone, Frank, "The Gaps Start to Close"Progressive Railroading, May 1987.

"On the Threshold of ATCS", Progressive Railroading, Dec. 1987.

"CP Advances in Train Control", Progressive Railroading, Sep. 1987.

"Communications/Signaling: Vital for dramatic railroad advances", Progressive Railroading, May 1988.

"ATCS's System Engineer", Progressive Railroading, Jul. 1988.

"The Electronic Railroad Emerges", Progressive Railroading, May 1989.

"$C^3$ Comes to the Railroads", Progressive Railroading, Sep. 1989.

"ATCS on Verge of Implementation", Progressive Railroading, Dec. 1989.

"ATCS Evolving on Railroads", Progressive Railroading, Dec. 1992.

"High Tech Advances Keep Railroads Rolling", Progressive Railroading, May 1994.

"FRA Promotes Technology to Avoid Train–To–Train Collisions", Progressive Railroading, Aug. 1994.

"ATCS Moving slowly but Steadily from Lab for Field", Progressive Railroading, Dec. 1994.

Judge, T., "Electronic Advances Keeping Railroads Rolling", Progressive Railroading, Jun. 1995.

"Electronic Advances Improve How Railroads Manage", Progressive Railroading, Dec. 1995.

Judge, T., "BNSF/UP PTS Pilot Advances in Northwest", Progressive Railroading, May 1996.

Foran, P., "Train control Quandary, Is CBTC viable? Railroads, Suppliers Hope Pilot Projects Provide Clues", Progressive Railroading, Jun. 1997.

"PTS Would've Prevented Silver Spring Crash: NTSB", Progressive Railroading, Jul. 1997.

Foran, P., "A 'Positive' Answer to the Interoperability Call", Progressive Railroading, Sep. 1997.

Foran, P., "How Safe is Safe Enough?", Progressive Railroading, Oct. 1997.

Foran, P., "A Controlling Interest In Interoperabibility", Progressive Railroading, Apr. 1998.

Derocher, Robert J., "Transit Projects Setting Pace for Train Control", Progressive Railroading, Jun. 1998.

Kube, K., "Variations on a Theme", Progressive Railroading, Dec. 2001.

Kube, K., "Innovation in Inches", Progressive Railroading, Feb. 2002.

Vantuono, W., "New York Leads a Revolution", Railway Age, Sep. 1996.

Vantuono, W., "Do you know where your train is?", Railway Age, Feb. 1996.

Gallamore, R., "The Curtain Rises on the Next Generation", Railway Age, Jul. 1998.

Burke, J., "How R&D is Shaping the 21st Century Railroad", Railway Age, Aug. 1998.

Vantuono, W., "CBTC: A Maturing Technology", Third International Conference On Communications Based Train Control, Railway Age, Jun. 1999.

Sullivan, T., "PTC—Is FRA Pushing Too Hard?", Railway Age, Aug. 1999.

Sullivan, T., "PTC: A Maturing Technology", Railway Age, Apr. 2000.

Moore, W., "How CBTC Can Increase Capacity", Railway Age, Apr. 2001.

Vantuono, W., "CBTC: The Jury is Still Out", Railway Age, Jun. 2001.

Vantuono, W., "New–tech Train Control Takes Off", Railway Age, May 2002.

Union Switch & Signal Intermittent Cab Signal, Bulletin 53, 1998.

GE Harris Product Sheet: "Advanced Systems for Optimizing Rail Performance" and "Advanced Products for Optimizing train Performance", undated.

GE Harris Product Sheet: "Advanced, Satellite–Based Warning System Enhances Operating Safety", undated.

Furman, E., et al., "Keeping Track of RF", GPS World, Feb. 2001.

Department of Transportation Federal Railroad Administration, Federal Register, vol. 66, No. 155, pp. 42352–42396, Aug. 10, 2001.

* cited by examiner

METHOD AND SYSTEM FOR CHECKING TRACK INTEGRITY

BACKGROUND OF THE INVENTION

1. Field of the Invention

The invention relates to railroads generally, and more particularly to a method and system for identifying problems with train tracks.

2. Discussion of the Background

Track circuits of various types have been used for many years in the railroad industry to determine whether sections or blocks of train track are safe for transit. These track circuits determine such things as whether there is a train in a section of track, whether there is a broken rail in a section of track, whether there has been an avalanche or whether snow or other debris is on the section of track, and whether the section of track is properly aligned with a bridge (with moveable and/or permanent spans). These and other such track circuits will be referred to herein as "track integrity circuits" or simply "track circuits."

Some known circuits combine the functions of detecting broken rails and detecting trains in a section of track. In their simplest form, these circuits involve applying a voltage across an electrically discontinuous section of rail at one end and measuring the voltage at the other end. If a train is present between the point at which the voltage is applied and the point at which the measuring device is located, the wheels and axle of the train will short the two rails and the voltage at the other end of the track will not be detected. Alternatively, if there is a break in one of the rails between the point at which the voltage is applied and the point at which the voltage measuring device is located, the voltage won't be detected. Thus, if the voltage cannot be detected, there is either a break in the rail or the track is occupied by another train. In either event, it is not safe for a train to enter the section of track monitored by the track circuit.

Many variations of such circuits have been proposed. Examples of such circuits can be found in U.S. Pat. Nos. 6,102,340; 5,743,495; 5,470,034; 5,145,131; 4,886,226; 4,728,063; and 4,306,694. These circuits vary in that some use A.C. signals while other employ D.C. signals. Additionally, some of these circuits employ radio links between the portions of the circuit which apply the signal to the rails and the portions of the circuit that detect the signals. There are yet other differences in these circuits. These differences are not important within the context of the present invention and any of these circuits may be used in connection with the invention.

In traditional systems, the track circuit was connected to a wayside color signal to indicate the status of the track to approaching trains and the track circuit operated continuously or periodically regardless of whether any train was approaching the section of track monitored by the track circuit. There are two major problems with such systems. First, the operation of the track circuit in the absence of an oncoming train wasted power. This limited the use of such systems to locations near a source of power. Second, the use of wayside signals was not failsafe in that it required the conductor/engineer to observe the signal and stop the train when the signals indicated that there was a problem such as a train on the track or a broken rail. Because human beings are not perfect, signals were sometimes missed and accidents resulted.

Some known systems solve the first problem by activating the track detection circuit only when a train is approaching. For example, U.S. Pat. No. 4,886,226 describes activating a broken rail circuit only when an approaching train triggers a "feed" positioned before the section of track monitored by the track circuit. While this solution does conserve power and allow the broken rail detection circuit to be used with a solar cell or battery power source, it has the disadvantage of high maintenance costs associated with the "feed". Another prior art system described in U.S. Pat. No. 4,728,063 requires a dispatcher to monitor a location of a train and activate a broken rail detection circuit by radio when the train nears the end of the block. The status of the track as reported by the broken rail detection circuit is then transmitted back to the dispatcher, who in turn passes it along by radio to the train. This system is inefficient in that it places an increased processing load on the dispatcher, as the dispatcher is forced to receive and send such messages each time each train reaches a new track circuit. It is also problematic when communications between the dispatcher and the broken rail detection circuit become interrupted.

Approach lit signaling is also know in the art. In those system, the signal lights are only lit when a train approaches the signal. However, in the systems known to the inventors, the track integrity circuit remains on even when the signal lights are out (the main reason the signal lights are turned off is to make the signal lights less attractive to vandals). Furthermore, the track integrity circuits in these systems conserve relatively large amounts of power. These systems are therefore not suitable for use with solar and/or battery power.

What is needed is a method and system for activating track circuits in an economical manner that allows such circuits to be used in a way that minimizes power consumption while avoiding undue burden on a dispatcher or other control authority.

SUMMARY OF THE INVENTION

The present invention meets the aforementioned need to a great extent by providing a computerized train control system in which a control module determines a position of a train using a positioning system such as a global positioning system (GPS) and consults a database to determine when the train is approaching a portion of track monitored by a track circuit. When the train is approaching a track circuit, but while the train is still far enough away from the track circuit that the train can be stopped before reaching the portion of track monitored by the track circuit, the train transmits an interrogation message to a transceiver associated with the track circuit. In preferred embodiments, the message is transmitted wirelessly to the track circuit. Other transmission methods are also possible, including transmitting an interrogation message to a transceiver associated with the track circuit via one or both of the rails. When the track circuit receives the interrogation message, a test is initiated. The results of the test are transmitted back to the train, which then takes some form of corrective action if the track circuit indicates a problem.

In some embodiments, the train will come to a complete stop before reaching the portion of the track monitored by the track circuit when a problem is indicated. In other embodiments, if the engineer/conductor acknowledges a message warning of the problem and slows the train to a safe speed, the system will allow the train to proceed at the safe speed while the engineer/conductor visually determines whether it is safe to continue. In such embodiments, the system will stop the train if the engineer/conductor fails to acknowledge the warning message or fails to slow the train to a safe speed. Preferably, the safe speed is determined on the basis of the weight of the train as well as other characteristics (e.g., the grade of the track, the distribution of the weight on the train, etc.) that affect braking distance.

BRIEF DESCRIPTION OF THE DRAWINGS

A more complete appreciation of the invention and many of the attendant features and advantages thereof will be readily obtained as the same become better understood by reference to the following detailed description when considered in connection with the accompanying drawings, wherein.

DETAILED DESCRIPTION OF PREFERRED EMBODIMENTS

The present invention will be discussed with reference to preferred embodiments of train control systems. Specific details, such as specific track circuits and signals, are set forth in order to provide a thorough understanding of the present invention. The preferred embodiments discussed herein should not be understood to limit the invention. Furthermore, for ease of understanding, certain method steps are delineated as separate steps; however, these steps should not be construed as necessarily distinct nor order dependent in their performance.

Figure 1:
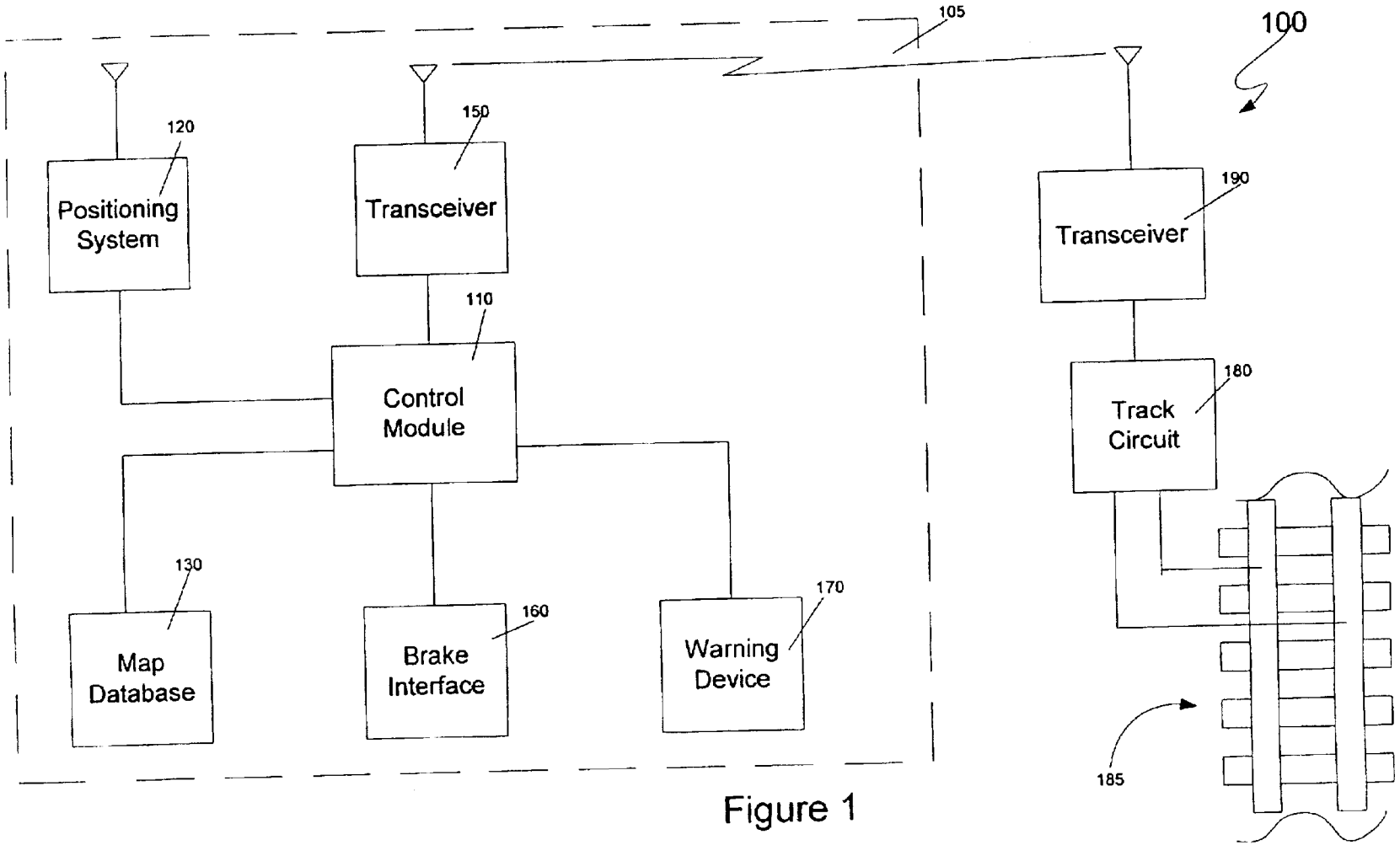
FIG. 1 is a logical block diagram of a train control system according to one embodiment of the invention.

Referring now to the drawings, wherein like reference numerals designate identical or corresponding parts throughout the several views, FIG. 1 is a logical block diagram of a train control system 100 according to an embodiment of the present invention. The train control system includes a train unit 105 and a plurality of pairs of track circuits 180 and transceivers 190 that monitor various sections of track 185. These track circuit 180/transceiver 190 pairs may be placed only at certain locations on the track 185 (e.g., only near mountainsides when the track circuits 185 are of the form of avalanche detection circuits), or may be positioned such that the entire length of track is monitored. It should also be noted that the track circuit 180 is not necessarily connected to the track rails themselves as is shown in FIG. 1. For example, avalanche detection circuits are typically connected to slide fences rather than to the track itself. In this case, the circuits detect breaks in the-slide fences, which indicate that debris has broken through the fence and, potentially, onto the track.

The train unit 105 includes a control module 110, which typically, but not necessarily, includes a microprocessor. The control module 110 is responsible for controlling the other components of the system.

A positioning system 120 is connected to the control module 110. The positioning system supplies the position (and, in some cases, the speed) of the train to the control module 110. The positioning can be of any type, including a global positioning system (GPS), a differential GPS, an inertial navigation system (INS), or a Loran system. Such positioning systems are well known in the art and will not be discussed in further detail herein. (As used herein, the term "positioning system" refers to the portion of a positioning system that is commonly located on a mobile vehicle, which may or may not comprise the entire system. Thus, for example, in connection with a global positioning system, the term "positioning system" as used herein refers to a GPS receiver and does not include the satellites that transmit information to the GPS receiver.)

A map database 130 is also connected to the control module 110. The map database 130 preferably comprises a non-volatile memory such as a hard disk, flash memory, CD-ROM or other storage device, on which map data is stored. Other types of memory, including volatile memory, may also be used. The map data preferably includes positions of all track circuits in the railway. The map data preferably also includes information concerning the direction and grade of the track in the railway. By using train position information obtained from the positioning system 120 as an index into the map database 140, the control module 110 can determine its position relative to track circuits.

When the control module 110 determines that the train is approaching a track circuit 180 (which includes a transceiver 190) that monitors a section of track 185 and is within range for conducting communications, it interrogates the device 180 through transceiver 150. The transceiver 150 can be configured for any type of communication, including communicating through rails and wireless communication. In addition to communicating with track circuit transceivers 190, the transceiver 150 may communicate with transceivers connected to other devices such as switches and grade crossing gates, and may also communicate with a dispatcher (not shown in FIG. 1) from whom route information and track warrants and authorities are received. In other embodiments, separate communications devices are used for wayside device communication and communication with a dispatcher.

Also connected to the control module 110 is a brake interface 160. The brake interface 160 monitors the train brakes and reports this information to the control module 110, and also allows the control module 110 to activate and control the brakes to stop or slow the train when necessary.

A warning device 170 is also connected to the control module 110. The warning device 170 is used to warn the conductor/engineer that a malfunction has been detected. The warning device 170 may also be used to allow the engineer/conductor to acknowledge the warning. In some embodiments, the warning device 170 is in the form of a button on an operator display such as the display illustrated in co-pending U.S. application Ser. No. 10/186,426, entitled, "Train Control System and Method of Controlling a Train or Trains" filed Jul. 2, 2002, the contents of which are hereby incorporated by reference herein. In other embodiments, the warning device 170 may be a stand-alone button that illuminates when a malfunction is detected. In yet other embodiments (e.g., those in which no acknowledgment of a warning is required), the warning device 170 may comprise or consist of a horn or other device capable of providing an audible warning.

Figure 2:
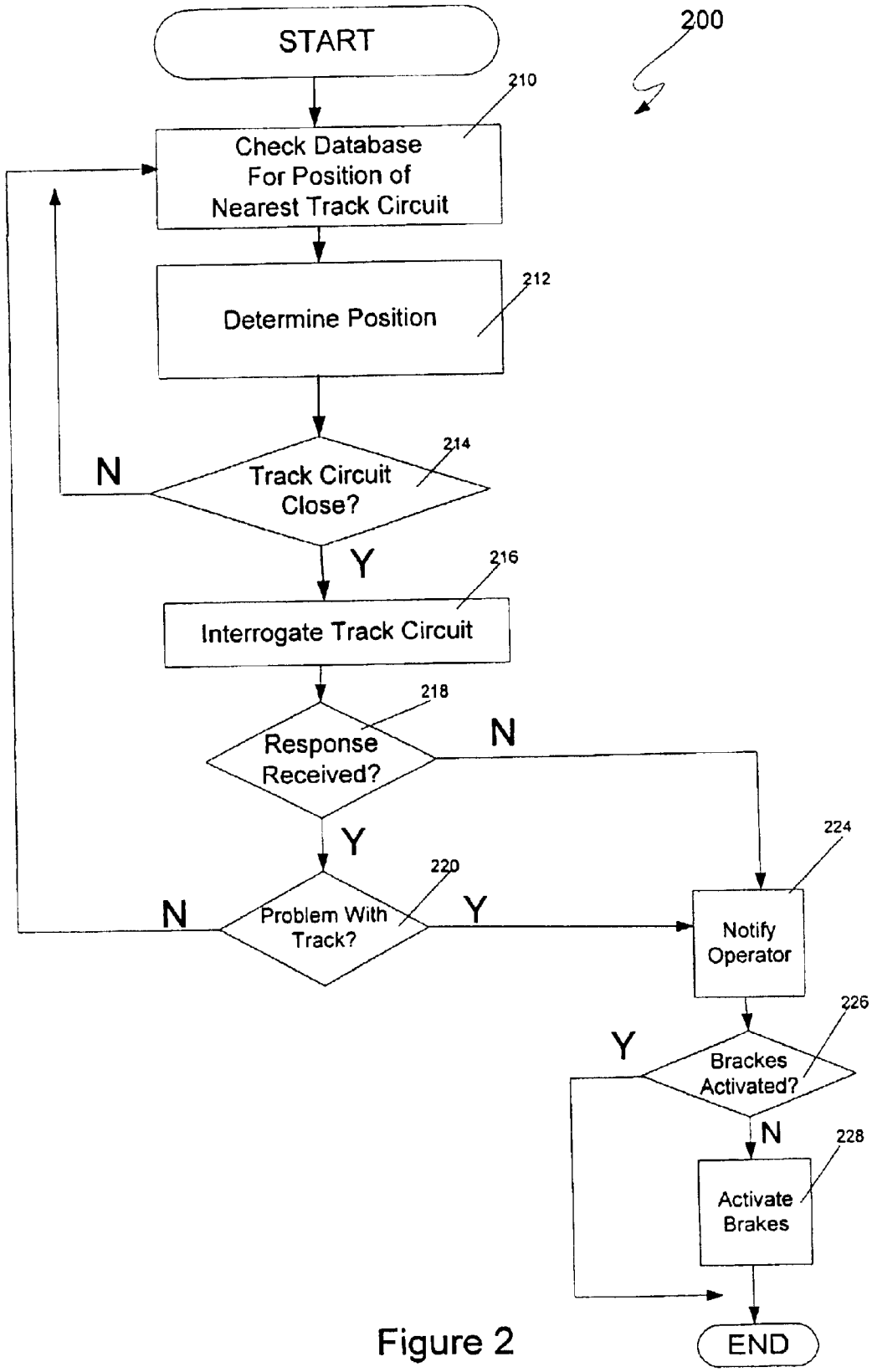
FIG. 2 is a flow chart of processing performed by the train control system of FIG. 1 in one embodiment of the invention.

FIG. 2 is a flowchart 200 illustrating operation of the control module 110 in connection with a track circuit 180 in one embodiment of the invention. In this embodiment, which is particularly well suited for use with track circuits such as broken rail detection circuits and avalanche detection circuits, the train will be preferably be brought to a complete halt, either by the operator or automatically by the control module 110 if the operator fails to take action, before reaching the section of track monitored by the track circuit.

Forcing the train to come to a complete stop forces an operator to make a positive decision to move the train forward through the section of track indicated as bad, thereby dramatically decreasing the chances that the operator will miss the warning provided by the track circuit. In some embodiments of the invention, permission from the dispatcher is required before the control module 110 will allow the train to move again.

The control module 110 begins the process by obtaining the locations of nearby track circuits 180 from the map database 130 at step 210. The control module 110 then determines the train's current position from information provided by the positioning system 120 at step 212. If no track circuit 180 is within a threshold distance, steps 210 et seq. are repeated. If a track circuit 180 is within a threshold distance at step 214, the transceiver 190 associated with the track circuit 180 is interrogated at step 216.

In some embodiments, this threshold distance is a predetermined distance based upon the communication ranges of the transceiver 150 on the train and the transceiver 190 connected to the track circuit 180. In other embodiments, the threshold distance is equal to a distance required to stop the train under a worst-case assumption (i.e., an assumption that a train having the greatest possible weight is traveling at a maximum allowable or possible speed in a downhill direction on a portion of track with the steepest grade in the system) plus an offset to allow the track circuit to perform the track test and respond to the interrogation. In yet other embodiments, the threshold is dynamically determined based on the actual speed and weight of the train and the grade of the track between the train and the track circuit such that there is sufficient time for the track circuit 180 to test the track 185 and report the results in response to the interrogation. In other embodiments, the calculation may take into account the distribution of weight in the train as this will effect the required stopping distance as discussed in the aforementioned co-pending U.S. patent application.

In some embodiments, the interrogation includes an identification number associated with the track circuit 180. This identification number is obtained from the map database 130. Only the track circuit corresponding to the identification number will respond to the interrogation. This avoids contention between multiple devices (track circuits or other devices—e.g., switches, crossing gates, etc.) attempting to respond to the interrogation on the same frequency. Thus, by assigning unique device numbers to track circuits and other devices, all devices can share the same frequency.

If the track circuit 180 fails to respond at step 218, or reports a problem with the track at step 220, the control module 110 warns the conductor/engineer of the problem via the warning device 170 at step 224. The control module 110 then determines whether the brakes have been activated at step 226 by communicating with the brake interface 160 directly and/or by obtaining speed information from the positioning system 120. Preferably, the control module 110 calculates the braking force necessary to stop the train prior to reaching the section of track monitored by the track circuit 180 taking into account the speed and weight of the train, the distribution of the weight on the train, the grade of the track, and the characteristics of the braking system itself. If the operator has not activated the brakes in a manner sufficient to stop the train in time at step 226, the control module 110 automatically activates the brakes to stop the train at step 228.

If the track circuit 180 responds to the interrogation at step 218 and reports that the track 185 is intact at step 220, then the control module 110 returns to step 210 to repeat the process. Returning to step 210 will result in interrogating the track circuit 180 device multiple times as the train approaches. This is desirable for safety purposes because it will detect any problems that occur after the initial interrogation (e.g., a vandal dislodging a rail) from causing and accident.

Whether or not the interrogation of step 218 includes the device's identification number, it is preferable for the device's response to include its identification number as this allows for greater assurance that a response from some other source has not been mistaken as a response from the track circuit 180 of interest.

Figure 3A:
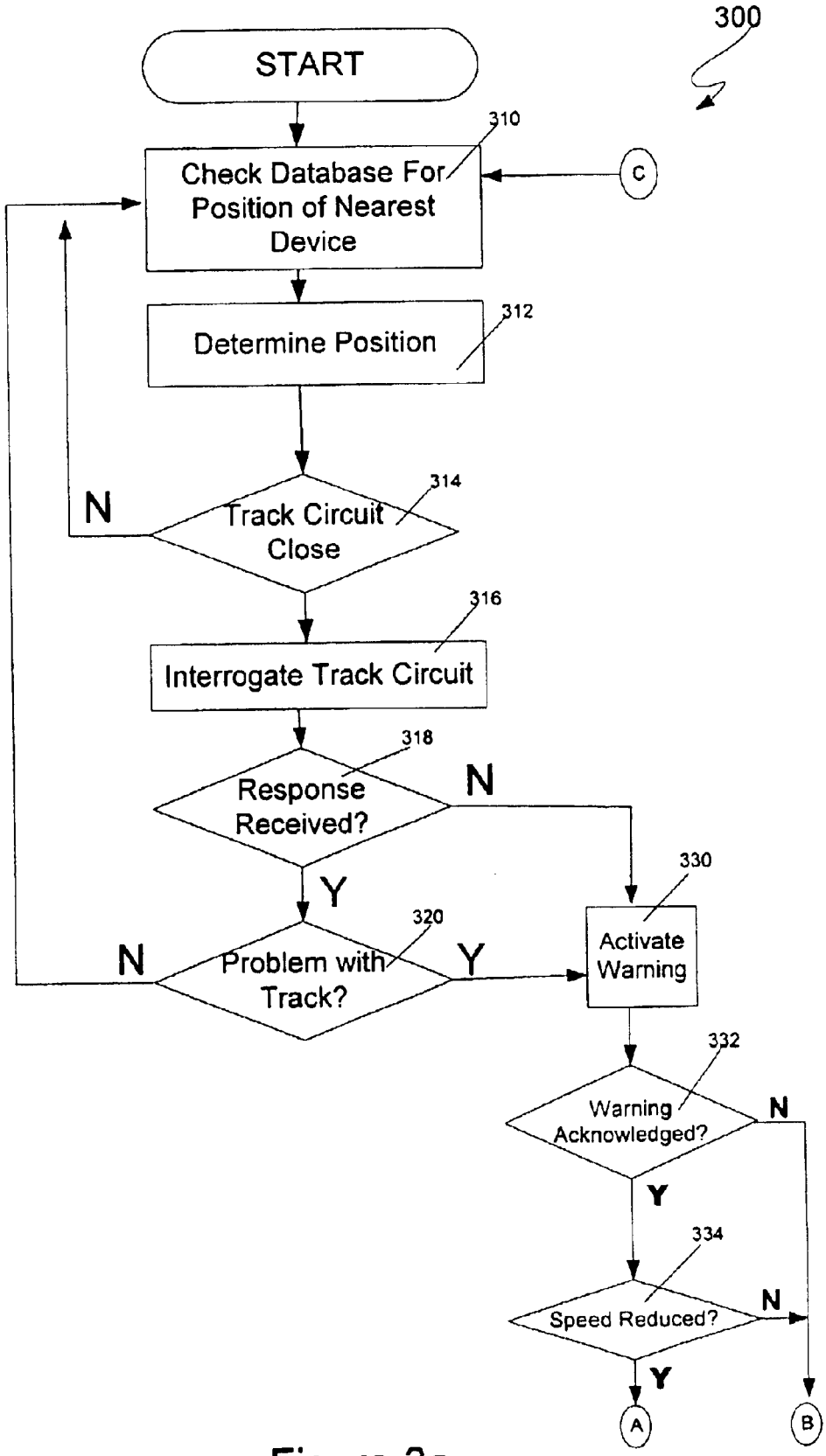
FIGS. 3*a* and 3*b* are a flow chart of processing performed by the train control system of FIG. 1 in a second embodiment of the invention.
Figure 3B:
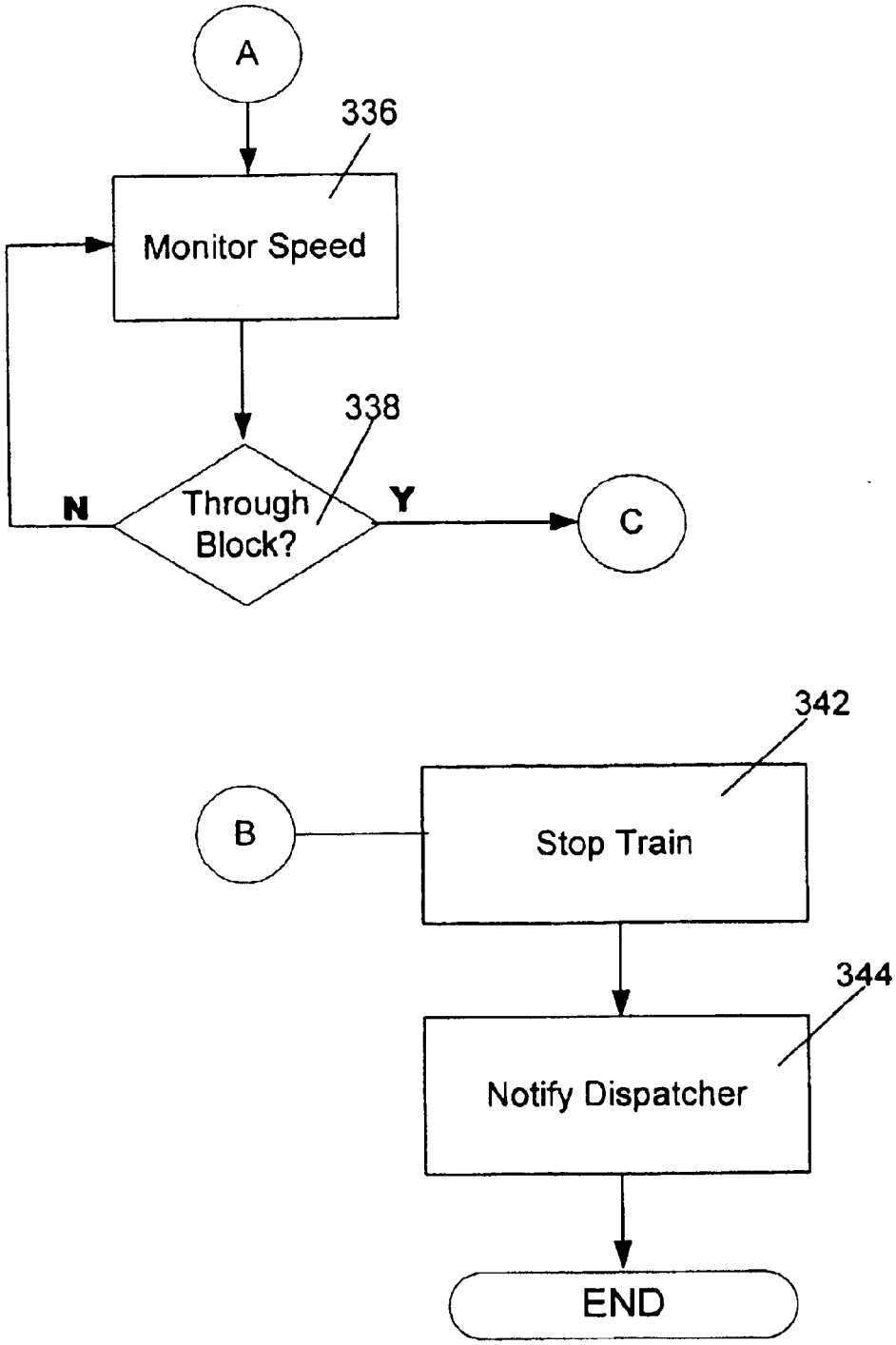

FIGS. 3*a* and 3*b* together form a flowchart 300 illustrating operation of the control unit 10 in connection with configurable devices 180 according to a second embodiment of the invention. This embodiment allows a train to proceed through a section of track at a reduced speed such that the train can be stopped if the operator visually determines that there is a problem with the track (e.g., a broken rail or another train on the tracks) rather than forcing the train to come to a complete halt. This is done because track circuits sometimes give a false indication of a problem. Steps 310–320 of the flowchart 300 are similar to steps 210–220 of the flowchart 200 of FIG. 2; therefore, the detailed discussion of these steps will not be repeated.

If a track circuit 180 does not respond at step 318 or reports a problem with the track 185 at step 320 after being interrogated at step 316, the control module 110 activates the warning device 170 at step 330. When the warning device 170 is activated, the operator/engineer is given a period of time in which to acknowledge the warning and slow the train to a speed that is slow enough to allow the operator to stop the train before reaching a problem (e.g., a broken rail or another train on the track) that the operator detects visually. This period of time may be predetermined based on a worst-case assumption of required distance to stop the train if the operator doesn't acknowledge the problem and slow the train to the safe speed, or may be determined dynamically based on factors such as the current speed of the train, the braking characteristics of the brakes on the train, the weight of the train, the distribution of weight on the train, and/or the grade of the track as determined from the map database 130 using the train position from the positioning system 120, as well as other factors that affect the required stopping distance/time.

If the operator acknowledges the warning at step 332 and reduces the speed of the train to the safe speed at step 334 within the allowable time period, the control module 110 monitors the train's speed such that the reduced speed is maintained at step 336 until the train has passed through the section of track monitored by the track circuit 180 at step 338.

If the conductor/engineer fails to acknowledge the warning at step 332 or fails to reduce the train's speed to the safe speed at step 334 within the allowed time period, the control module 110 commands the brake interface to stop the train at step 342. The control module 110 then notifies the dispatcher of the stopped train at step 344.

One advantage of those embodiments of the invention in which a configurable device is interrogated as the train approaches is that such devices are not required to transmit information when trains are not in the area. This saves power as compared to those systems in which wayside devices continuously or periodically transmit information regardless of whether a train is close enough to receive such information.

As discussed above, preferred embodiments of the invention include an identification number in the interrogation messages sent to transponders 190 associated with track circuits 180. However, it is also possible to transmit interrogation messages without identification numbers, in which case each transporter that receives the interrogation will respond and include an identification number in its response. In either case, this allows all transponders to share the same frequency, which reduces complexity and cost.

In the embodiments discussed above, the control module 110 is located on the train. It should also be noted that some or all of the functions performed by the control module 110 could be performed by a remotely located processing unit such as processing unit located at a central dispatcher. In such embodiments, information from devices on the train (e.g., the brake interface 160) is communicated to the remotely located processing unit via the transceiver 150.

One particularly important advantage of the invention is that it facilitates use of track circuits in remote areas. That is, because an approaching train transmits an interrogation message, the track detection circuit need only be "on" when the train approaches and may be in a low-power standby or off state with the transceiver in a low power "listening state" at other times when no train is nearby. This in turn facilitates the use of solar cells as a power source for these track circuit/transponder combinations. Furthermore, no high-maintenance mechanical device is required to detect the presence of the train. An important consequence of this is that the invention provides the ability to include broken rail protection in dark territory in which no power source is available at low cost.

Another important aspect of the invention is its failsafe nature. Because the control unit 110 ensures that corrective action is taken if the track circuit 180 does not respond to an interrogation, there is no danger if the track circuit 180 and/or the track circuit transceiver 190 fails to respond, thereby making the system failsafe. This also eliminates the need to perform preventive maintenance. Additionally, no signal lights are necessary, which eliminates a failure mode. Maintenance costs are dramatically reduced as a consequence of these two aspects.

Obviously, numerous modifications and variations of the present invention are possible in light of the above teachings. It is therefore to be understood that within the scope of the appended claims, the invention may be practiced otherwise than as specifically described herein.

What is claimed is:

1. A system for controlling a train, the system comprising:

a control unit;

a warning device in communication with the control unit;

a brake interface unit, the brake interface unit being in communication with the control unit and a train brake, the brake interface unit being operable to activate the train brake under control of the control unit; and a transceiver, the transceiver being located on the train and being in communication with the control unit;

wherein the control unit is configured to perform the steps of transmitting an interrogation message to a track circuit transceiver associated with a track circuit;

listening for a response from the track circuit transceiver, the response including an indication as to a condition of a section of track monitored by the track circuit;

allowing the train to continue if a response with an indication that it is safe for the train to proceed is received; and activating the warning device if the response indicates that it is not safe for the train to proceed.

2. The system of claim 1, where the control unit is further configured to perform the steps of:

activating the train brake via the brake interface unit if necessary to stop the train before reaching the section of track monitored by the track circuit otherwise.

3. The system of claim 1, wherein the track circuit is a broken rail detection circuit.

4. The system of claim 1, wherein the track circuit is a circuit that detects the presence of a train.

5. The system of claim 1, wherein the track circuit is an avalanche detection circuit.

6. The system of claim 1, wherein the track circuit is a bridge alignment detection circuit.

7. The system of claim 1, wherein the response includes an identification number of the track circuit and wherein the control unit is further configured to perform the step of confirming that identification number received in the response corresponds to the track circuit to which the interrogation message was directed.

8. The system of claim 1, wherein the interrogation message includes an identification number of a track circuit for which the interrogation message is intended.

9. The system of claim 1, further comprising:

a positioning system, the positioning system being in communications with the control unit and being configured to provide position information to the control unit; and a database, the database including a plurality of locations for a plurality of track circuits;

wherein the control unit is further configured to perform the steps of identifying a track circuit in the database which is a next track circuit which the train will pass based on information from the positioning system; and obtaining an identification number from the database associated with the track circuit identified in the identifying step.

10. The system of claim 9, wherein the control unit is configured to transmit the interrogation message when a distance between the train's location and the track circuit identified in the identifying step is below a threshold.

11. The system of claim 10, wherein the threshold is a predetermined number based at least in part on an expected worst case distance required to stop the train.

12. The system of claim 10, wherein the threshold is determined dynamically based at least in part upon the current speed of the train.

13. The system of claim 12, wherein the threshold is further based on a weight of the train.

14. The system of claim 12, wherein the database further includes a grade of a track between the train and the track circuit and the threshold is further based on the grade of the track between the train and the track circuit.

15. The system of claim 14, wherein the threshold is further based on distribution of weight in the train.

16. The system of claim 1, wherein the control unit is further configured to activate the warning device when a response with a correct configuration is not received.

17. The system of claim 16, wherein the control unit is further configured to perform the step of preventing the train from continuing until an acknowledgment of the activated warning device has been received.

18. The system of claim 1, where in the warning device is a display.

19. The system of claim 1, wherein the warning device is a horn.

20. A method for controlling a train comprising the steps of:

transmitting an interrogation message to a track circuit transceiver associated with a track circuit near the train;

listening for a response from the track circuit transceiver, the response including an indication as to a condition of a section of track monitored by the track circuit; and reporting the response to a person operating the train.

21. The method of claim 20, further comprising the steps of:

allowing the train to continue if a response indicating that it is safe for the train to proceed is received; and activating the train brake if necessary to stop the train before reaching the section of track monitored by the track circuit otherwise.

22. The method of claim 20, wherein the track circuit is a broken rail detection circuit.

23. The method of claim 20, wherein the track circuit is a circuit that detects the presence of a train.

24. The method of claim 20, wherein the track circuit is an avalanche detection circuit.

25. The method of claim 20, wherein the track circuit is a bridge alignment detection circuit.

26. The method of claim 20, wherein the response includes an identification number of the track circuit and the method further comprises the step of confirming that identification number received in the response corresponds to the track circuit to which the interrogation message was directed.

27. The method of claim 20, wherein the interrogation message includes an identification number of the track circuit for which the interrogation message is intended.

28. The method of claim 20, further comprising the steps of:

identifying a track circuit in a database which is a next track circuit which the train will pass based on information from a positioning system located on the train; and obtaining an identification number associated with the track circuit identified in the identifying step from the database.

29. The method of claim 28, wherein the interrogation message is transmitted when a distance between the train's location and the track circuit identified in the identifying step is below a threshold.

30. The method of claim 29, wherein the threshold is a predetermined number based at least in part on an expected worst case distance required to stop the train.

31. The method of claim 29, wherein the threshold is determined dynamically based at least in part upon the current speed of the train.

32. The method of claim 31, wherein the threshold is further based on a weight of the train.

33. The method of claim 31, wherein the database further includes a grade of a track between the train and the section of track monitored by the track circuit and the threshold is further based on a grade of the track between the train and the section of track monitored by the track circuit.

34. The method of claim 33, wherein the threshold is further based on distribution of weight in the train.

35. The method of claim 20, further comprising the step of activating a warning device when a response with a correct configuration is not received.

36. The method of claim 35, further comprising the step of preventing the train from continuing until an acknowledgment of the activated warning device has been received.

37. A system for controlling a train, the system comprising:

a control unit;

a warning device connected to the control unit;

a brake interface unit, the brake interface unit being in communication with the control unit and connected to a train brake, the brake interface unit being operable to activate the train brake under control of the control unit; and a transceiver, the transceiver being located on the train and being in communication with the control unit;

wherein the control unit is configured to perform the steps of transmitting an interrogation message to a track circuit transceiver associated with a track circuit near the train;

listening for a response from the track circuit transceiver, the response including an indication as to a condition of a section of track monitored by the track circuit;

allowing the train to continue if the response indicates that it is safe for the train to proceed is received;

if no response is received or if a response with an indication that it is not safe to proceed is received, activating a warning device to provide a warning;

stopping the train by activating the brakes via the brake interface unit if an acknowledgment of the warning is not received or the train is not slowed to a safe speed within a period of time; and if an acknowledgment of the warning is received and the train is slowed to the safe speed within the period of time, ensuring that the safe speed is maintained until the section of track has been passed.

38. The system of claim 37, wherein the warning device is a horn.

39. The system of claim 37, wherein the warning device is a display.

40. The system of claim 38, wherein the control unit is further configured to perform the step of preventing the train continuing until permission is received from a dispatcher if the train has been stopped by the control unit in the stopping step.

41. The system of claim 37, wherein the period of time is based on a worst-case assumption that the train is traveling at a maximum speed and weighs a maximum amount.

42. The system of claim 37, further comprising a positioning system in communication with the control unit and located on the train, wherein the period of time is based on an actual speed of the train based on information reported by the positioning system and a weight of the train.

43. The system of claim 37, further comprising a track database in communication with the control unit, wherein the period of time is further based on a grade of a section of track between the train and the track circuit.

44. The system of claim 37, wherein the track circuit is a broken rail detection circuit.

45. The system of claim 37, wherein the track circuit is a circuit that detects the presence of a train.

46. The system of claim 37, wherein the track circuit is an avalanche detection circuit.

47. The system of claim 37, wherein the track circuit is a bridge alignment detection circuit.

48. The system of claim 37, wherein the response includes an identification number of the track circuit and wherein the control unit is further configured to perform the step of confirming that identification number received in the response corresponds to the track circuit to which the interrogation message was directed.

49. The system of claim 37, wherein the interrogation message includes an identification number of a track circuit for which the interrogation message is intended.

50. A method for controlling a train comprising the steps of:

transmitting an interrogation message to a track circuit transceiver associated with a track circuit near the train, the track circuit being configured to monitor a section of track;

listening for a response from the track circuit, the response including an indication as to a condition of a section of track monitored by the track circuit;

allowing the train to continue if a response indicating that it is safe for the train to proceed is received;

if a response with a correct configuration is not received or if the response indicates that it is not safe for the train to proceed, reducing a speed of the train;

activating a warning device to provide a warning;

stopping the train if an acknowledgment of the warning is not received with a period of time or the train is not reduced to a safe speed; and if an acknowledgment of the warning is received and the train is reduced to the safe speed within the period of time, ensuring that the safe speed is maintained until the section of track monitored by the track circuit has been passed.

51. The method of claim 50, wherein the period of time is based on a worst-case assumption that the train is traveling at a maximum speed and weighs a maximum amount.

52. The method of claim 50, wherein the period of time is based on an actual speed of the train based on information reported by a positioning system and a weight of the train.

53. The method of claim 52, wherein the period of time is further based on a grade of a section of track between the train and the track circuit.

54. The method of claim 50, wherein the track circuit is a broken rail detection circuit.

55. The method of claim 50, wherein the track circuit is a circuit that detects the presence of a train.

56. The method of claim 50, wherein the track circuit is an avalanche detection circuit.

57. The method of claim 50, wherein the track circuit is a bridge alignment detection circuit.

58. The method of claim 50, wherein the response includes an identification number of the track circuit and wherein the control unit is further configured to perform the step of confirming that identification number received in the response corresponds to the track circuit to which the interrogation message was directed.

59. The method of claim 50, wherein the interrogation message includes an identification number of a track circuit for which the interrogation message is intended.

60. The system of claim 1, wherein the track circuit is in a low power state where no train is nearby.

61. The system of claim 1, wherein the track circuit is in an off state when no train is nearby.

62. The system of claim 1, wherein the track circuit transceiver is in a low power state when no train is nearby.

63. The method of claim 20, wherein the track circuit is in a low power state where no train is nearby.

64. The method of claim 20, wherein the track circuit is in an off state when no train is nearby.

65. The method of claim 20, wherein the track circuit transceiver is in a low power state when no train is nearby.

66. The method of claim 37, wherein the track circuit is in a low power state where no train is nearby.

67. The method of claim 37, wherein the track circuit is in an off state when no train is nearby.

68. The method of claim 37, wherein the track circuit transceiver is in a low power state when no train is nearby.

69. The method of claim 50, wherein the track circuit is in a low power state where no train is nearby.

70. The system of claim 50, wherein the track circuit is in an off state when no train is nearby.

71. The system of claim 50, wherein the track circuit transceiver is in a low power state when no train is nearby.

* * * * *